US012426698B2

(12) United States Patent
King

(10) Patent No.: US 12,426,698 B2
(45) Date of Patent: Sep. 30, 2025

(54) HAIR CARE PRODUCTS STORAGE DEVICE

(71) Applicant: Brian King, Indianapolis, IN (US)

(72) Inventor: Brian King, Indianapolis, IN (US)

( * ) Notice: Subject to any disclaimer, the term of this patent is extended or adjusted under 35 U.S.C. 154(b) by 212 days.

(21) Appl. No.: 18/389,154

(22) Filed: Nov. 13, 2023

(65) Prior Publication Data

US 2025/0151877 A1 May 15, 2025

(51) Int. Cl.
*A45D 34/06* (2006.01)

(52) U.S. Cl.
CPC ..... *A45D 34/06* (2013.01); *A45D 2200/05* (2013.01); *A45D 2200/15* (2013.01); *A45D 2200/25* (2013.01)

(58) Field of Classification Search
CPC .... A45D 34/06; A45D 34/00; A45D 2200/05; A45D 2200/15; A45D 2200/25
USPC ..... 206/349, 576, 577, 581
See application file for complete search history.

(56) References Cited

U.S. PATENT DOCUMENTS 3,386,184 A 6/1968 Ponczek
5,054,615 A * 10/1991 Stillwagon ..... A45D 1/00 211/70.6
7,472,455 B2 1/2009 Dolton
7,513,361 B1 * 4/2009 Mills, Jr. ..... A45D 44/00 206/234
8,689,999 B2 * 4/2014 Cooper ..... A45D 44/04 206/823
8,893,731 B2 * 11/2014 Pires ..... A45D 40/18 206/209
D746,588 S 1/2016 Pourmehr
2009/0173653 A1 * 7/2009 Steenblik ..... G09F 13/16 206/459.5
2013/0056017 A1 3/2013 Rigsby
2022/0071362 A1 3/2022 Jakes
2023/0148755 A1 5/2023 Chapman

FOREIGN PATENT DOCUMENTS

WO WO2005009170 2/2005

* cited by examiner

*Primary Examiner* — Jacob K Ackun

(57) ABSTRACT

A hair care products storage device includes a box which is comprised of a heat resistant material to resist being damaged by heat produced by heated hair care tools. A pair of shelves is each disposed within the box for supporting the heated hair care tools for storage. A plurality of first heat sensors and a plurality of second heat sensors is each integrated into a respective one of the pair of shelves. A pair of doors is each hingedly coupled to the box for opening or closing the storage space defined in the box. A temperature alarm is integrated into the box and the temperature alarm emits an audible alert when either of the first heat sensors or the second heat sensors senses a temperature that exceeds a pre-determined threshold temperature thereby alerting a user to the potential danger posed by the heated hair care tools.

9 Claims, 6 Drawing Sheets

HAIR CARE PRODUCTS STORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hair care storage device and more particularly pertains to a new hair care storage device for storing hair care products and heated hair care tools. The device includes a box for storing hair care products and heated hair care tools. The device includes a box comprised of a heat resistant material and a pair of shelves integrated into the box and a plurality of heat sensors each integrated into a respective shelf for sensing heat produced by a heated hair care tool. The device includes an alarm that is triggered when either of the heat sensors senses heat that exceeds a pre-determined threshold temperature to alert a user that the heated hair care tool is producing too much heat.

(2) Description of Related Art Including Information Disclosed Under 37 CFR 1.97 and 1.98

The prior art relates to hair care storage devices including a variety of transportation cases for transporting various personal care items and a portable hair styling kit that includes a variety of heated hair care items and powered clippers. In no instance does the prior art disclose a hair care product carrying box that includes heat sensors for sensing the temperature of heated hair care tools and an alarm integrated into the box when any of the heat sensors senses a temperature that exceeds a pre-determined threshold temperature for alerting a user that the heated hair care tools have been left on.

BRIEF SUMMARY OF THE INVENTION

An embodiment of the disclosure meets the needs presented above by generally comprising a box which is comprised of a heat resistant material to resist being damaged by heat produced by heated hair care tools. A pair of shelves is each disposed within the box for supporting the heated hair care tools for storage. A plurality of first heat sensors and a plurality of second heat sensors is each integrated into a respective one of the pair of shelves. A pair of doors is each hingedly coupled to the box for opening or closing the storage space defined in the box. A temperature alarm is integrated into the box and the temperature alarm emits an audible alert when either of the first heat sensors or the second heat sensors senses a temperature that exceeds a pre-determined threshold temperature thereby alerting a user to the potential danger posed by the heated hair care tools.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
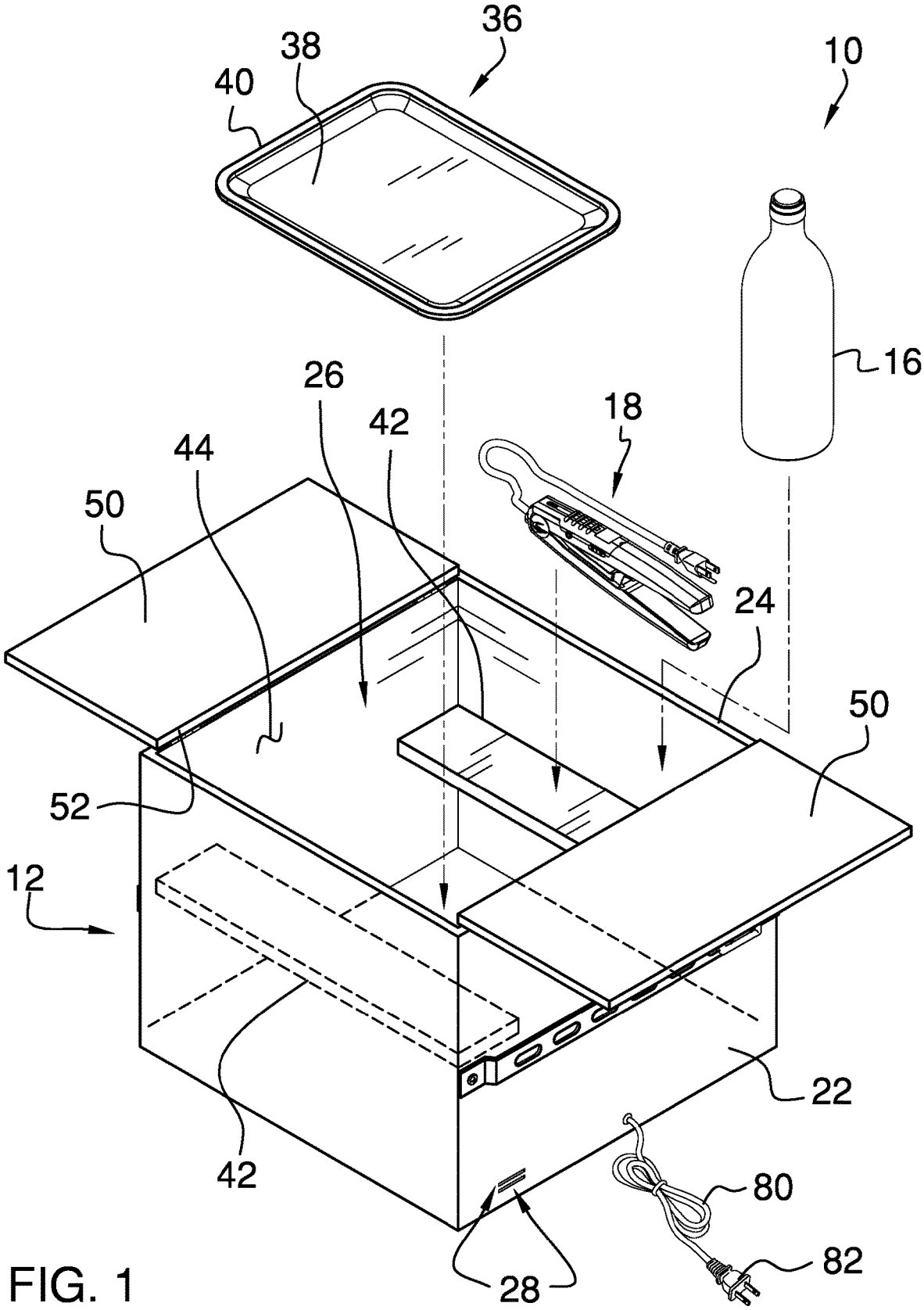
FIG. 1 is a phantom exploded view of a hair care products storage device according to an embodiment of the disclosure.
Figure 2:
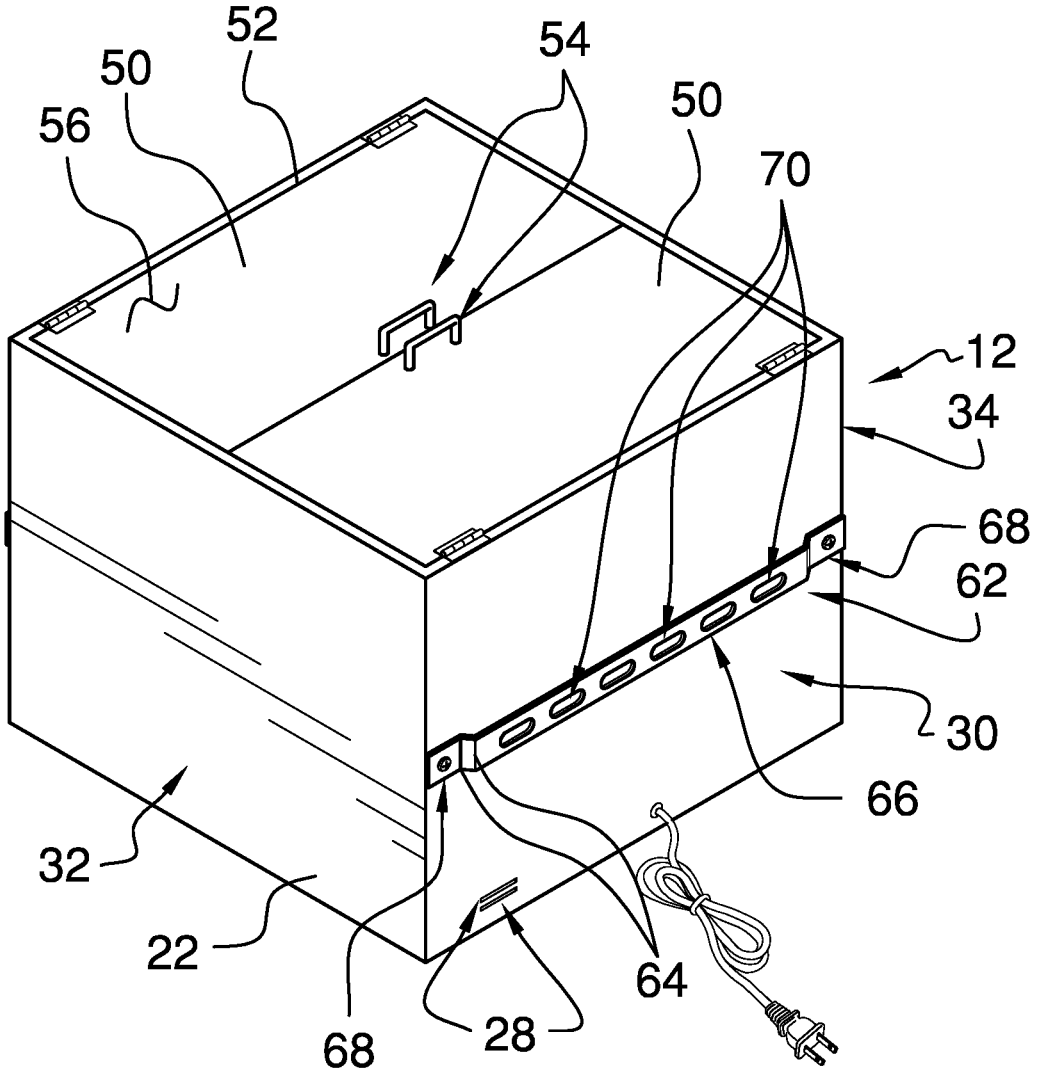
FIG. 2 is a top perspective view of an embodiment of the disclosure.
Figure 3:
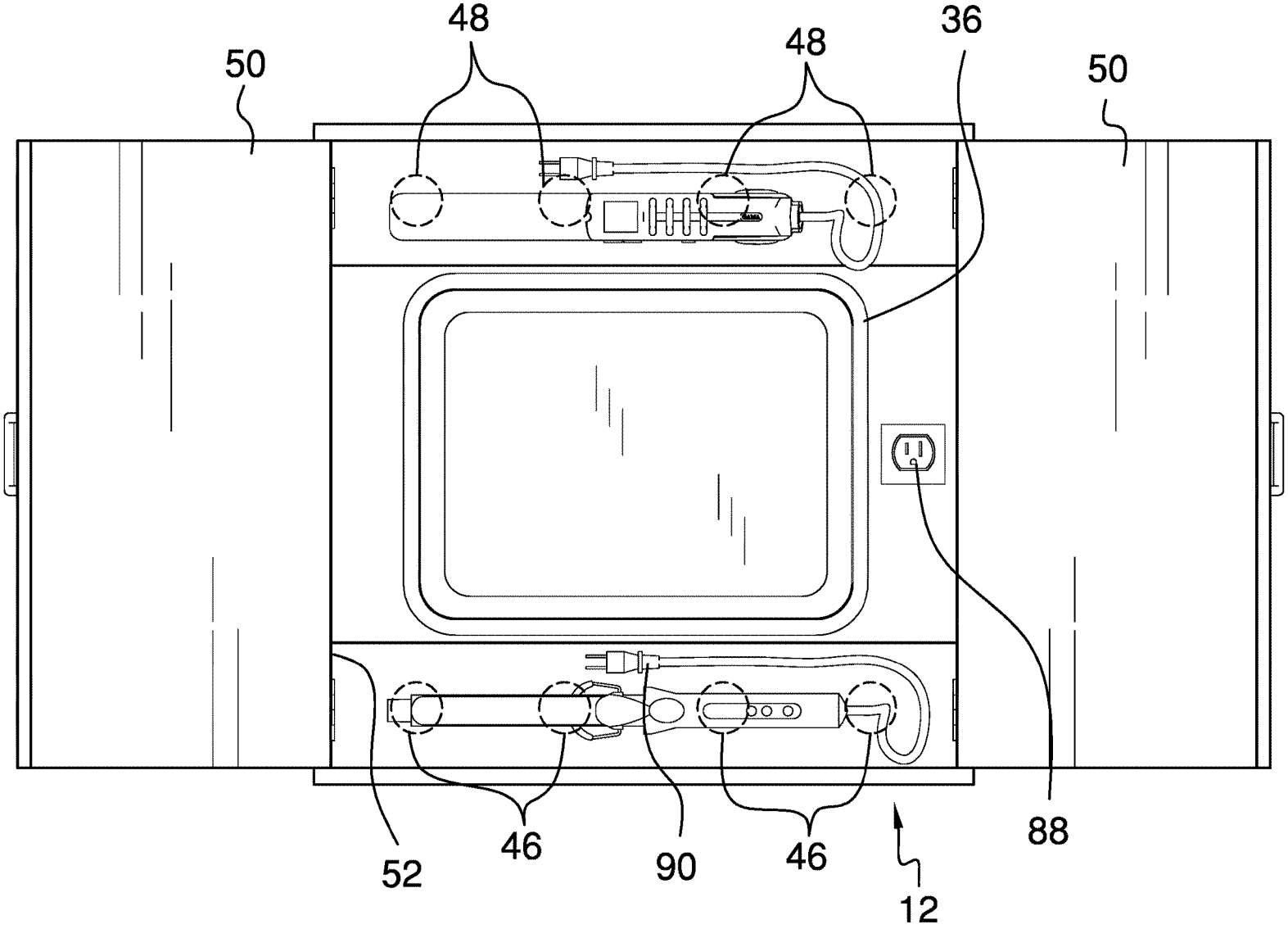
FIG. 3 is a top view of an embodiment of the disclosure.
Figure 4:
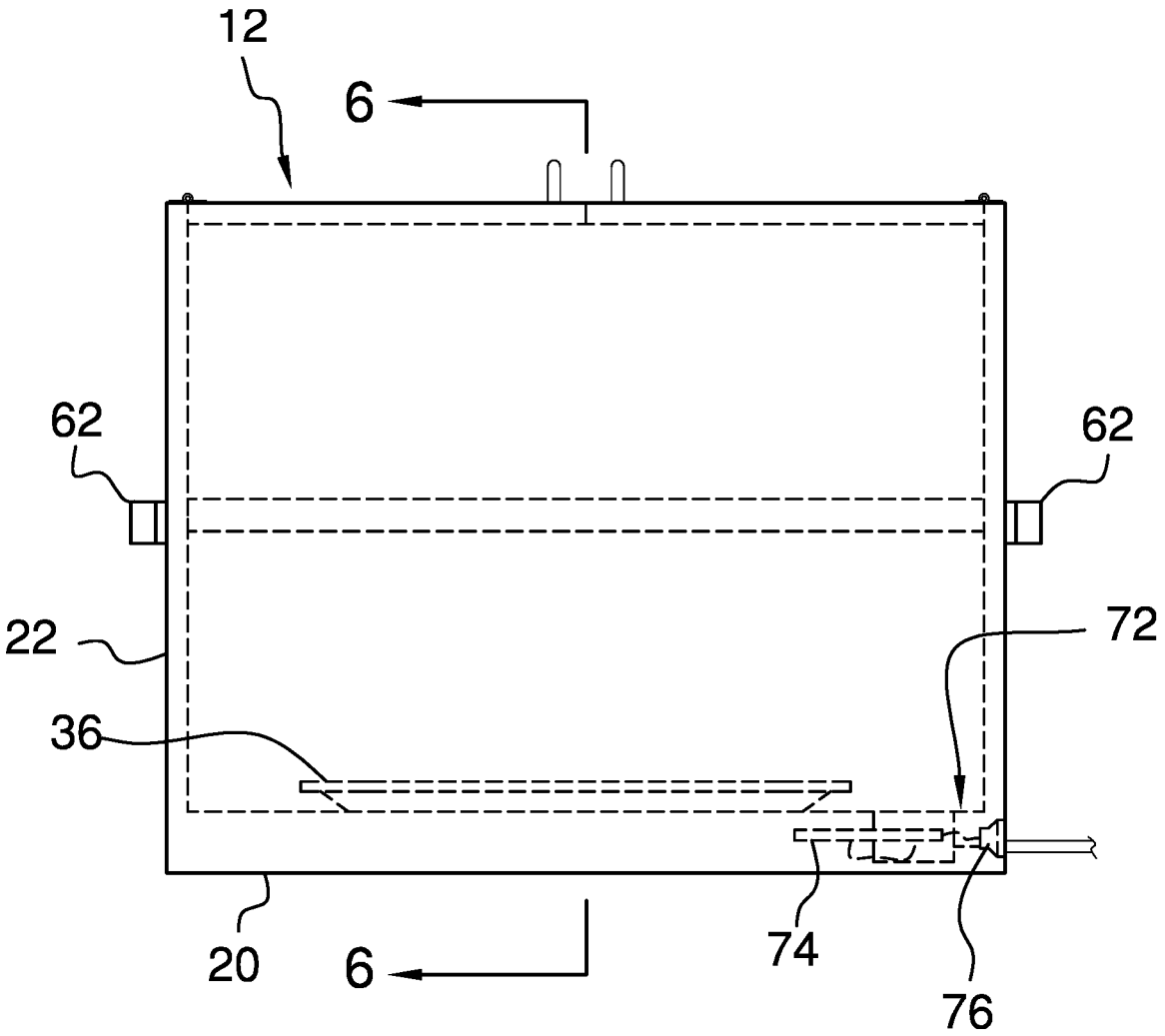
FIG. 4 is a front view of an embodiment of the disclosure.
Figure 5:
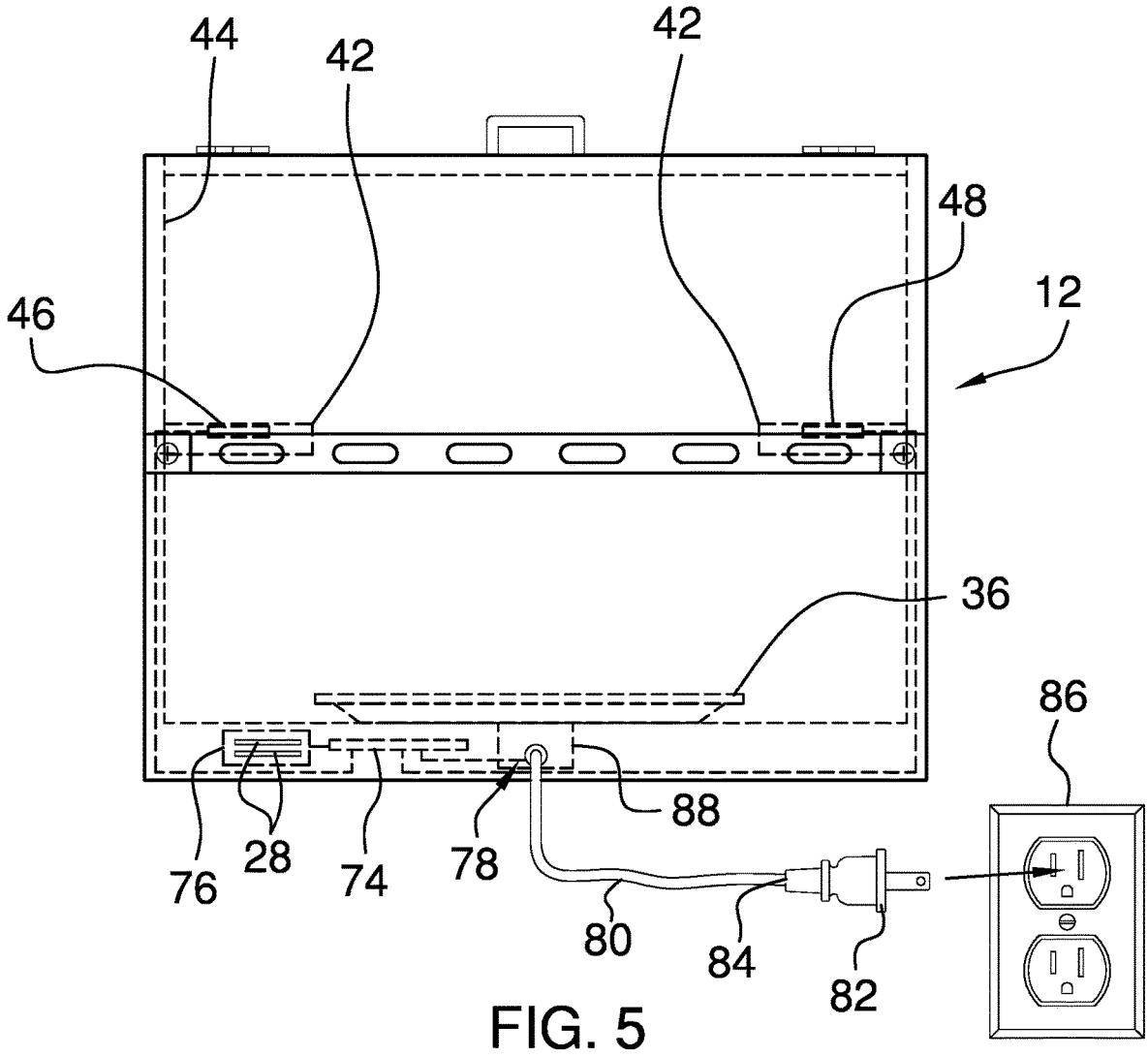
FIG. 5 is a left side view of an embodiment of the disclosure.
Figure 6:
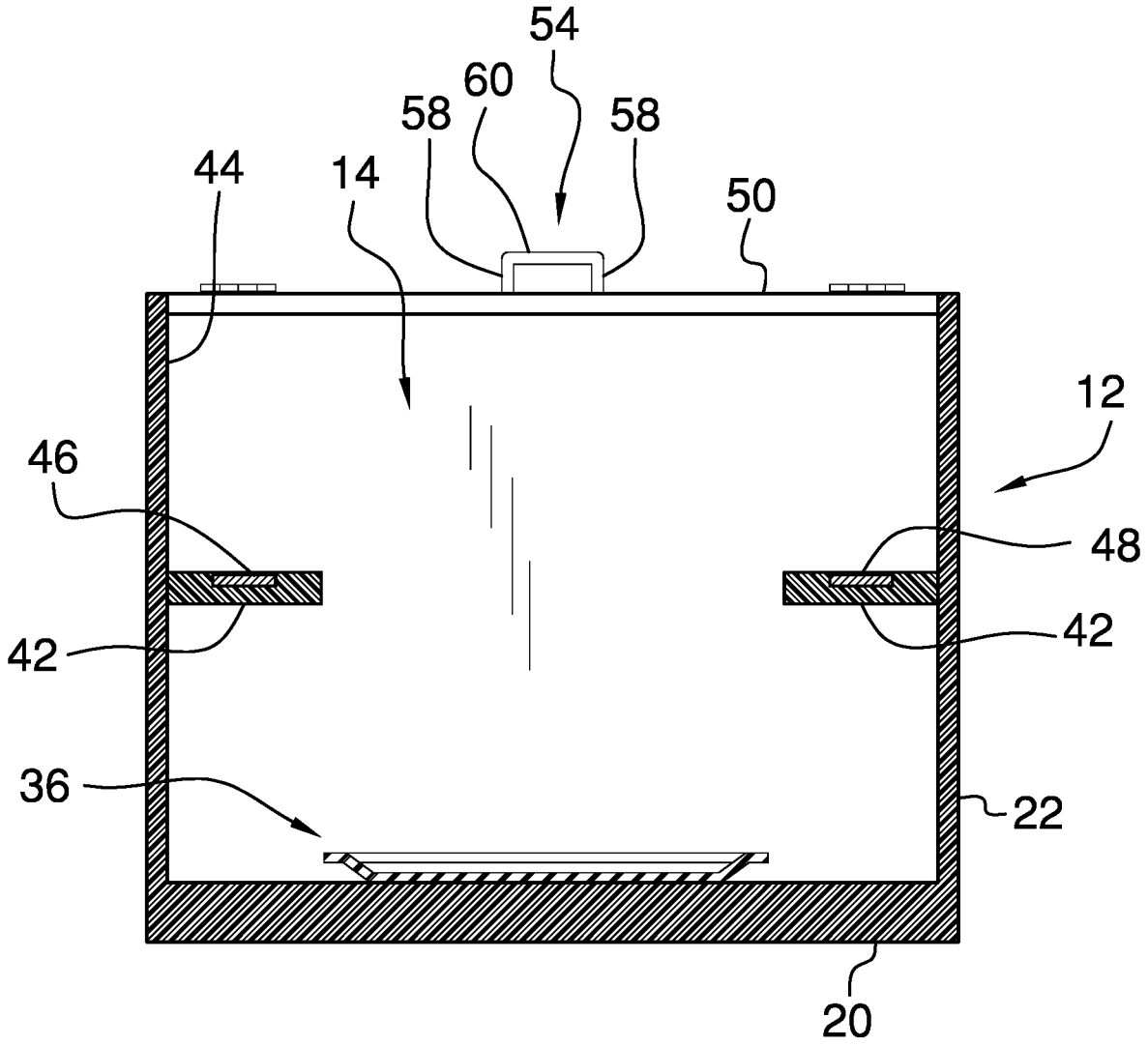
FIG. 6 is a cross sectional view taken along line 6-6 of FIG. 4 of an embodiment of the disclosure.

With reference now to the drawings, and in particular to FIGS. 1 through 6 thereof, a new hair care storage device embodying the principles and concepts of an embodiment of the disclosure and generally designated by the reference numeral 10 will be described.

As best illustrated in FIGS. 1 through 6, the hair care products storage device 10 generally comprises a box 12 which defines a storage space 14 to contain hair care products 16 and heated hair care tools 18. The heated hair care tools 18 may include, but not be limited to, an electric hair crimper and an electric hair curler. The box 12 is comprised of a heat resistant material, including but not being limited to plastic or metal, to resist being damaged by heat produced by the heated hair care tools 18. The box 12 has a bottom wall 20 and a perimeter wall 22 extending upwardly from the bottom wall 20 and the perimeter wall 22 has a top edge 24 defining an opening 26 into the storage space 14.

The perimeter wall 22 has a pair of sound slots 28 each extending through a first lateral side 30 of the perimeter wall 22 and each of the pair of sound slots 28 is positioned closer to the bottom wall 20 than the top edge 24 of the perimeter wall 22. Each of the pair of sound slots 28 is elongated to extend along a lengthwise axis of the first lateral side 30. Additionally, each of the pair of sound slots 28 is positioned closer to a front side 32 of the perimeter wall 22 than a back side 34 of the perimeter wall 22.

A tray 36 is positioned in the box 12 to store liquid hair care products 16, including but not being limited to hair dye, hair conditioner, shampoo or other fluid hair care products. The tray 36 has a basal wall 38 and an outside wall 40 sloping upwardly from the basal wall 38. The outside wall 40 extends around a full perimeter of the basal wall 38. Additionally, the basal wall 38 rests upon the bottom wall 20 of the box 12 when the tray 36 is positioned in the box 12.

A pair of shelves 42 is provided and each of the pair of shelves 42 is disposed within the box 12. A respective one of the heated hair care tools 18 can be positioned upon each of the shelves 42 for storage. Each of the pair of shelves 42 is comprised of a heat resistant material, including but not being limited to plastic or metal. In this way the shelves 42 can resist being damaged by heat produced by the heated hair care tools 18. Each of the pair of shelves 42 is attached to an inside surface 44 of the perimeter wall 22 of the box 12 and each of the shelves 42 is positioned on a respective one of the front side 32 and the back side 34 of the perimeter wall 22. Additionally, each of the pair of shelves 42 is centrally positioned between the top edge 24 of the perimeter wall 22 and the bottom wall 20.

A plurality of first heat sensors 46 is each integrated into a respective one of the pair of shelves 42. Each of the plurality of first heat sensors 46 is in thermal communication with the heated hair care tool 18 that is positioned on the respective shelf 42. Additionally, the first heat sensors 46 are spaced apart from each other and are distributed along a full length of the respective shelf 42. A plurality of second heat sensors 48 is each integrated into a respective one of the pair of shelves 42. Each of the plurality of second heat sensors 48 is in thermal communication with the heated hair care tool 18 that is positioned on the respective shelf 42. Additionally, the second heat sensors 48 are spaced apart from each other and are distributed along a full length of the respective shelf 42. Each of the first heat sensors 46 and each of the second heat sensors 48 may comprise an electronic heat sensor or the like.

A pair of doors 50 is provided and each of the pair of doors 50 is hingedly coupled to the box 12 thereby facilitating each of the pair of doors 50 to be positioned between an open position or a closed position for opening or closing the storage space 14 defined in the box 12. Each of the pair of doors 50 is comprised of a heat resistant material, including but not being limited to plastic or metal, to resist being damaged by heat produced by the heated hair care tools 18. Each of the pair of doors 50 has a coupled edge 52 that is hingedly coupled to the inside surface 44 of the perimeter wall 22 at a point located adjacent to the top edge 24 of the perimeter wall 22. Additionally, each of the doors 50 is positioned on a respective one of the first lateral side 30 and a second lateral side 46 of the perimeter wall 22.

A pair of handles 54 is provided and each of the pair of handles 54 is coupled to an upper surface 56 of a respective one of the pair of doors 50. In this way each of the pair of handles 54 can be gripped for urging the pair of doors 50 between the closed position and the open position. Each of the pair of handles 54 comprises a pair of outward members 58 each extending away from the upper surface 56 of the respective door 50 and a central member 60 that is spaced from the upper surface 56.

A pair of interlocking strips 62 is provided and each of the pair of interlocking strips 62 has a series of bends 64 which define a middle portion 66 which extends between a pair of end portions 68. Each of the pair of end portions 68 of each of the pair of interlocking strips 62 rests against a respective one of the first lateral side 30 and the second lateral side 46 of the perimeter wall 22 of the box 12 having the middle portion 66 of each of the pair of interlocking strips 62 being spaced from the perimeter wall 22. Each of the pair of interlocking strips 62 is centrally positioned between the top edge 24 of the perimeter wall 22 and the bottom wall 20. Additionally, each of the plurality of interlocking strips 62 has a plurality of holes 70 each extending through the middle portion 66 and the holes 70 are spaced apart from each other and are distributed along the middle portion 66.

A temperature alarm 72 is provided and the temperature alarm 72 is integrated into the box 12. The temperature alarm 72 is in communication with each of the plurality of first heat sensors 46 and each of the plurality of second heat sensors 48. Additionally, the temperature alarm 72 emits an audible alert when either of the first heat sensors 46 or the second heat sensors 48 senses a temperature that exceeds a pre-determined threshold temperature. In this way a user is alerted to the potential danger posed by the heated hair care tools 18. The pre-determined threshold temperature may be a temperature of approximately 300.0 degrees Fahrenheit.

The temperature alarm 72 comprises a processor 74 that is integrated into the box 12 and the processor 74 receives an alarm input. The processor 74 is electrically coupled to each of the plurality of first heat sensors 46 and each of the plurality of second heat sensors 48. Additionally, the processor 74 receives the alarm input when either of the plurality of first heat sensors 46 or the plurality of second heat sensors 48 senses a temperature that exceeds the pre-determined threshold temperature. The temperature alarm 72 includes a speaker 76 that is attached to the perimeter wall 22 of the box 12. The speaker 76 is aligned with the sound slots 28 in the front side 32 of the perimeter wall 22 of the box 12 to emit audible sound through the pair of sound slots 28. Additionally, the speaker 76 is electrically coupled to the processor 74 and the speaker 76 is actuated when the processor 74 receives the alarm input.

A power supply 78 is integrated into the box 12 and the power supply 78 is electrically coupled to the processor 74. The power supply 78 comprises a power cord 80 that is coupled to and extends away from the first lateral side 30 of the perimeter wall 22 of the box 12. A male plug 82 is electrically coupled to a distal end 84 of the power cord 80 and the male plug 82 can be plugged into a power source 86 comprising a female electrical outlet. Additionally, the power cord 80 is electrically coupled to the processor 74. The power supply 78 includes a female electrical outlet 88 that is integrated into the bottom wall 20 of the box 12. A power cord 90 from one of the heated hair care tools 18 can be plugged into the female electrical outlet 88 and the female electrical outlet 88 is electrically coupled to the power cord 80 of the power supply 78.

In use, the hair care products 16 are stored in the box 12 and each of the heated hair care tools 18 is positioned on a respective one of the shelves 42 for storing the hair care products 16 and the heated hair care tools 18. The speaker 76 emits the audible alarm when either of the first heat sensors 46 or the second heat sensors 48 senses a temperature that exceeds the predetermined threshold temperature.

In this way a user can be alerted that one or more of the heated hair care tools 18 have been left on while being stored in the box 12. In this way the heated hair care tools 18 can be prevented from potentially causing a fire or damaging the hair care products 16 that are stored in the box 12. Furthermore, the box 12 facilitates the hair care products 16 and the heated hair care tools 18 to be neatly stored and organized thereby reducing clutter in a bathroom, for example, and to facilitate the hair care products 16 and the heated hair care tools 18 to be transported.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hair care products storage device for storing hair care products and heated hair care tools, said device comprising:

a box defining a storage space wherein said storage space is configured to contain hair care products and heated hair care tools, said box being comprised of a heat resistant material wherein said box is configured to resist being damaged by heat produced by said heated hair care tools;

a tray being positioned in said box wherein said tray is configured to store liquid hair care products;

a pair of shelves, each of said pair of shelves being disposed within said box wherein each of said pair of shelves is configured to have a respective one of the heated hair care tools positioned upon said shelves for storage, each of said pair of shelves being comprised of a heat resistant material wherein each of said pair of shelves is configured to resist being damaged by heat produced by the heated hair care tools;

a plurality of first heat sensors, each of said plurality of first heat sensors being integrated into a respective one of said pair of shelves wherein each of said plurality of first heat sensors is configured to be in thermal communication with the heated hair care tool that is positioned on said respective shelf;

a plurality of second heat sensors, each of said plurality of second heat sensors being integrated into a respective one of said pair of shelves wherein each of said plurality of second heat sensors is configured to be in thermal communication with the heated hair care tool that is positioned on said respective shelf;

a pair of doors, each of said pair of doors being hingedly coupled to said box thereby facilitating each of said pair of doors to be positioned between an open position or a closed position for opening or closing said storage space defined in said box, each of said pair of doors being comprised of a heat resistant material wherein each of said pair of doors is configured to resist being damaged by heat produced by the heated hair care tools; and a temperature alarm being integrated into said box, said temperature alarm being in communication with each of said plurality of first heat sensors and each of said plurality of second heat sensors, said temperature alarm emitting an audible alert when either of said first heat sensors or said second heat sensors senses a temperature that exceeds a pre-determined threshold temperature thereby alerting a user to the potential danger posed by the heated hair care tools.

2. The storage device according to claim 1, wherein:

said box has a bottom wall and a perimeter wall extending upwardly from said bottom wall;

said perimeter wall has a top edge defining an opening into said storage space;

said perimeter wall has a pair of sound slots each extending through a first lateral side of said outer wall;

each of said pair of sound slots is positioned closer to said bottom wall than said top edge of said perimeter wall;

each of said pair of sound slots is elongated to extend along a lengthwise axis of said first lateral side;

each of said pair of sound slots is positioned closer to a front side of said perimeter wall than a back side of said perimeter wall;

said tray having a basal wall and an outside sloping upwardly from said basal wall;

said outside wall extends around a full perimeter of said basal wall; and said basal wall rests upon said bottom wall of said box.

3. The storage device according to claim 2, wherein:

each of said pair of shelves is attached to an inside surface of said perimeter wall of said box;

each of said shelves is positioned on a respective one of said front side and said back side of said perimeter wall; and each of said pair of shelves is centrally positioned between said top edge of said perimeter wall and said bottom wall.

4. The storage device according to claim 2, wherein:

each of said pair of doors has a coupled edge being hingedly coupled to said inside surface of said perimeter wall at a point located adjacent to said top edge of said perimeter wall; and each of said doors is positioned on a respective one of said first lateral side and a second lateral side of said perimeter wall.

5. The storage device according to claim 1, wherein:

said assembly includes a pair of handles;

each of said pair of handles is coupled to an upper surface of a respective one of said pair of doors wherein each of said pair of handles is configured to be gripped for urging said pair of doors between said closed position and said open position; and each of said pair of handles comprises a pair of outward members each extending away from said upper surface of said respective door and a central member being spaced from said upper surface.

6. The storage device according to claim 2, wherein:

said assembly includes a pair of interlocking strips;

each of said pair of interlocking strips has a series of bends which define a middle portion which extends between a pair of end portions;

each of said pair of end portions of each of said pair of interlocking strips rests against a respective one of said first lateral side and said second lateral side of said perimeter wall of said box having said middle portion of each of said pair of interlocking strips being spaced from said perimeter wall;

each of said pair of interlocking strips is centrally positioned between said top edge of said perimeter wall and said bottom wall;

each of said plurality of interlocking strips has a plurality of holes each extending through said middle portion; and said holes are spaced apart from each other and are distributed along said middle portion.

7. The storage device according to claim 2, wherein said temperature alarm comprises:

a processor being integrated into said box, said processor receiving an alarm input, said processor being electrically coupled to each of said plurality of first heat sensors and each of said plurality of second heat sensors, said processor receiving said alarm input when either of said plurality of first heat sensors or said plurality of second heat sensors senses a temperature that exceeds said pre-determined threshold temperature; and a speaker being attached to said perimeter wall of said box, said speaker being aligned with said sound slots in said front side of said perimeter wall of said box wherein said speaker is configured to emit audible sound through said pair of sound slots, said speaker being electrically coupled to said processor, said speaker being actuated when said processor receives said alarm input.

8. The storage device according to claim 7, further comprising a power supply being integrated into said box, said power supply being electrically coupled to said processor, said power supply comprising:

a power cord being coupled to and extending away from said first lateral side of said perimeter wall of said box, said power cord having a male plug being electrically coupled to a distal end of said power cord wherein said male plug is configured to be plugged into a power source comprising a female electrical outlet, said power cord being electrically coupled to said processor; and a female electrical outlet being integrated into said bottom wall of said box wherein said female electrical outlet is configured to have a power cord from one of the heated hair care tools plugged into said female electrical outlet, said female electrical outlet being electrically coupled to said power cord.

9. A hair care products storage device for storing hair care products and heated hair care tools, said device comprising:

a box defining a storage space wherein said storage space is configured to contain hair care products and heated hair care tools, said box being comprised of a heat resistant material wherein said box is configured to resist being damaged by heat produced by said heated hair care tools, said box having a bottom wall and a perimeter wall extending upwardly from said bottom wall, said perimeter wall having a top edge defining an opening into said storage space, said perimeter wall having a pair of sound slots each extending through a first lateral side of said outer wall, each of said pair of sound slots being positioned closer to said bottom wall than said top edge of said perimeter wall, each of said pair of sound slots being elongated to extend along a lengthwise axis of said first lateral side, each of said pair of sound slots being positioned closer to a front side of said perimeter wall than a back side of said perimeter wall;

a tray being positioned in said box wherein said tray is configured to store liquid hair care products, said tray having a basal wall and an outside sloping upwardly from said basal wall, said outside wall extending around a full perimeter of said basal wall, said basal wall resting upon said bottom wall of said box;

a pair of shelves, each of said pair of shelves being disposed within said box wherein each of said pair of shelves is configured to have a respective one of the heated hair care tools positioned upon said shelves for storage, each of said pair of shelves being comprised of a heat resistant material wherein each of said pair of shelves is configured to resist being damaged by heat produced by the heated hair care tools, each of said pair of shelves being attached to an inside surface of said perimeter wall of said box, each of said shelves being positioned on a respective one of said front side and said back side of said perimeter wall, each of said pair of shelves being centrally positioned between said top edge of said perimeter wall and said bottom wall;

a plurality of first heat sensors, each of said plurality of first heat sensors being integrated into a respective one of said pair of shelves wherein each of said plurality of first heat sensors is configured to be in thermal communication with the heated hair care tool that is positioned on said respective shelf, each of said plurality of first heat sensors being spaced apart from each other and being distributed along a full length of said respective shelf;

a plurality of second heat sensors, each of said plurality of second heat sensors being integrated into a respective one of said pair of shelves wherein each of said plurality of second heat sensors is configured to be in thermal communication with the heated hair care tool that is positioned on said respective shelf, each of said plurality of second heat sensors being spaced apart from each other and being distributed along a full length of said respective shelf;

a pair of doors, each of said pair of doors being hingedly coupled to said box thereby facilitating each of said pair of doors to be positioned between an open position or a closed position for opening or closing said storage space defined in said box, each of said pair of doors being comprised of a heat resistant material wherein each of said pair of doors is configured to resist being damaged by heat produced by the heated hair care tools, each of said pair of doors having a coupled edge being hingedly coupled to said inside surface of said perimeter wall at a point located adjacent to said top edge of said perimeter wall, each of said doors being positioned on a respective one of said first lateral side and a second lateral side of said perimeter wall;

a pair of handles, each of said pair of handles being coupled to an upper surface of a respective one of said pair of doors wherein each of said pair of handles is configured to be gripped for urging said pair of doors between said closed position and said open position, each of said pair of handles comprising a pair of outward members each extending away from said upper surface of said respective door and a central member being spaced from said upper surface;

a pair of interlocking strips, each of said pair of interlocking strips having a series of bends which define a middle portion which extends between a pair of end portions, each of said pair of end portions of each of said pair of interlocking strips resting against a respective one of said first lateral side and said second lateral side of said perimeter wall of said box having said middle portion of each of said pair of interlocking strips being spaced from said perimeter wall, each of said pair of interlocking strips being centrally positioned between said top edge of said perimeter wall and said bottom wall, each of said plurality of interlocking strips having a plurality of holes each extending through said middle portion, said plurality of holes being spaced apart from each other and being distributed along said middle portion;

a temperature alarm being integrated into said box, said temperature alarm being in communication with each of said plurality of first heat sensors and each of said plurality of second heat sensors, said temperature alarm emitting an audible alert when either of said first heat sensors or said second heat sensors senses a temperature that exceeds a pre-determined threshold temperature thereby alerting a user to the potential danger posed by the heated hair care tools, said temperature alarm comprising:

a processor being integrated into said box, said processor receiving an alarm input, said processor being electrically coupled to each of said plurality of first heat sensors and each of said plurality of second heat sensors, said processor receiving said alarm input when either of said plurality of first heat sensors or said plurality of second heat sensors senses a temperature that exceeds said pre-determined threshold temperature; and a speaker being attached to said perimeter wall of said box, said speaker being aligned with said sound slots in said front side of said perimeter wall of said box wherein said speaker is configured to emit audible sound through said pair of sound slots, said speaker being electrically coupled to said processor, said speaker being actuated when said processor receives said alarm input; and a power supply being integrated into said box, said power supply being electrically coupled to said processor, said power supply comprising:

a power cord being coupled to and extending away from said first lateral side of said perimeter wall of said box, said power cord having a male plug being electrically coupled to a distal end of said power cord wherein said male plug is configured to be plugged into a power source comprising a female electrical outlet, said power cord being electrically coupled to said processor; and a female electrical outlet being integrated into said bottom wall of said box wherein said female electrical outlet is configured to have a power cord from one of the heated hair care tools plugged into said female electrical outlet, said female electrical outlet being electrically coupled to said power cord.

* * * * *